US007476158B1

(12) United States Patent
Cayse

(10) Patent No.: US 7,476,158 B1
(45) Date of Patent: Jan. 13, 2009

(54) GOLF TRAINING MACHINE

(76) Inventor: Raymond T. Cayse, 10231-2 White Oak Ave., Northridge, CA (US) 91325

( * ) Notice: Subject to any disclaimer, the term of this patent is extended or adjusted under 35 U.S.C. 154(b) by 0 days.

(21) Appl. No.: 11/900,253

(22) Filed: Sep. 10, 2007

(51) Int. Cl.
*A63B 69/36* (2006.01)

(52) U.S. Cl. ..... 473/258; 473/229

(58) Field of Classification Search ..... 473/219, 473/226, 229, 231, 256, 257, 258, 260, 261, 473/262, 264, 265
See application file for complete search history.

(56) References Cited

U.S. PATENT DOCUMENTS 2,858,133 A * 10/1958 Self ..... 473/229
4,984,802 A * 1/1991 Barraclough ..... 473/229
5,013,045 A * 5/1991 Elmore ..... 473/229
5,501,452 A * 3/1996 Halvorson ..... 473/260
6,443,852 B1 * 9/2002 Kim ..... 473/265

* cited by examiner

*Primary Examiner*—Nini Legesse

(57) ABSTRACT

A golf training machine that clearly demonstrates to a trainee the two optimum golf swing methods, namely the so-called "inward" swing method and the so-called "outward" swing method. The training machine is a tandem-type golf training machine that allows an instructor to work directly with a trainee positioned on the opposite side of the machine. In carrying out a training session, both the instructor and the trainee are putting toward the same target in a manner to positively convey to the trainee the differences between the two swing methods.

17 Claims, 4 Drawing Sheets

GOLF TRAINING MACHINE

BACKGROUND OF THE INVENTION

1. Field of the Invention

The present invention relates generally to golf swing training devices. More particularly, the invention concerns a machine for conveying to a trainee the differences between two putter swing methods, namely the "inward" swing method and the "outward" swing method.

2. Discussion of the Prior Art

It is generally agreed that there are two mutually exclusive and equally effective optimum golf swings, namely the so-called "inward" golf swing and the so-called "outward" golf swing. It is also generally agreed that the golf swing embodies two separate applications of geometry, both of which must be properly addressed in an effective golf swing. The first of these, namely "Impact geometry" concerns the fact that one must compress the ball on the face of the club head in such a manner that maximum swing force is transferred. Accomplishing this without side spin is the ideal, but most accomplished golfers use either a draw spin or a fade spin in carrying out the majority of their shots.

The other application of geometry, namely "force controlling geometry," produces the physics that controls the transfer of the total swing force to the club head. Most good golfers develop a feel for an effective swing through a trial and error method ("muscle memory") that is inconsistent at best. Adding to the difficulty with this approach is the fact that there are two diametrically opposed procedures for effectively releasing the club head, each with its own unique feel. Mostly because of this fact, contradictory advice has always plagued the game; more often by being incomplete, rather than totally wrong.

The forgoing and various other theories concerning the golf swing have been discussed in numerous books and articles, including books by Ben Hogan and Horner Kelley.

Ben Hogan in his noted work, *Five Lessons: The Modern Fundamentals of Golf* likened the swing plane to a large flat pane of glass inclined from the intended line of flight of the ball and generally resting on the shoulders of the trainee. In Hogan's theory, the glass pane intersected the ground in a line which was coincident with the line of flight. To control club movement, the golfer ideally swung the club head underneath the plane throughout the swing. However, Hogan introduced a slight shift in the plane line in the downswing to account for the apparent motion of the club head outward and away from the golfer from hip height through impact.

Horner Kelley in his well known book *The Golfing Machine* describes the swing plane as a two dimensional geometric structure on which the entire club moves throughout the golf swing. Kelley pictured the swing plane as a flat pane of glass intersecting the ground in a line, with the plane line being identical with the intended initial line of flight of the ball. This plane was described by Kelley as having a dynamically changing inclined angle during the swing with the entire club remaining on the plane throughout the swing.

Kelley mentions in his book that, depending on the number of accumulators used, that is, parts of his "power package", a golf swing can be anything from a simple "one barrel" to a full "four barrel" version.

The inward and outward swings, which are taught to be recognized by the trainee through the use of the apparatus of the present invention, can be explained in terms of the Kelley concepts as follows: Basically there are five basic elements of the golf swing, the lower body (hips), the upper body (shoulders), the leading arm, the hands, and the shaft flex. These five elements are released in the sequence listed in the downswing of each swing method. However, each element has the potential to release in either direction, that is, inward or outward. As such, they have the capacity to create torque four times by opposing each other in sequential fashion. It is these four potential segments of torque that actually establish the number of barrels a swing contains and, thereby, its ability to create effortless power.

In performing the golf swing, each of the five basic elements of the golf swing is indirectly affected by each of the others. For example, the hips are outward when they are adding to the turning force of the swing through impact and they are inward when they are resisting this force. The shoulders act similarly, but must act in an opposite direction to the hips for a four barrel swing to result. The leading arm is outward when the angle formed by it and the shoulders is increasing (Kelley's #4 accumulator); and it is inward when this angle is decreasing through impact. The action of the hands and club shaft are similar to the action of the hips and shoulders.

The importance of understanding and being able to recognize the two swing methods discussed in the preceding paragraphs is highlighted by the fact that, while most touring professionals are inward swingers there are some notable exceptions, including Jack Nicklaus, Greg Norman, Fred Couples and John Daly. Examples of renowned inward swingers include Arnold Palmer, Lee Trevino, Steve Ellington and Nick Faldo.

Teachers of golf and authors of books and articles on the golf swing almost always fall into one category or the other. For example, Ben Hogan's *Five Lessons, The Modern Fundamentals of Golf* tends to favor the inward swing, while Leslie King's *Master key to Good Golf* tends to favor the outward swing.

SUMMARY OF THE INVENTION

It is an object of the invention to provide a golf training machine that clearly demonstrates to a trainee the two optimum golf swing methods, namely the so-called "inward" swing method and the so-called "outward" swing method.

Another object of the invention is to provide a tandem-type golf training machine of the aforementioned character that allows an instructor to work directly with a trainee positioned on the opposite side of the machine. In carrying out a training session, both the instructor and the trainee are putting toward the same target in a manner to positively convey to the trainee the differences between the two swing methods.

Another object of the invention is to provide a tandem-type golf training machine as described in the preceding paragraphs that can be readily adjusted so that the trainee can experience both swing methods while the instructor maintains a high degree of control over the entire training process.

By way of summary, one form of the tandem-type golf training machine of the invention comprises an aluminum frame having suspended therewithin a clear plexus-glass tube containing nine large ball bearings that can roll back and forth within the tube. A guide on each side of the frame guides the travel of two putters, one moved by the instructor and the other by the trainee. The tube, which is held in place by cords at each end of the tube, can sway back and forth between the two golfers in response to movement by the putters. The ball bearings respond to this movement in a manner analogous to shaft flex action, i.e., away from the target (inward swing) and toward the target (outward swing). Each golfer opposes this shaft flex action with the appropriate hand action. The interaction between these two opposing actions produces effortless power and accuracy in equal amounts thereby causing the putts to roll out to similar distances and on similar paths. The two swings are timed differently in that the putters swing back together, then the inward swing is made and then the outward swing follows. The clubs are interconnected to the device by means of a cord attached to a novel pivot plate that is, in turn, attached to the plexi-glass tube. The movement of the two putters away from the target causes the ball bearings to roll to the aft end of the tube and then forward with the downswing of the inward swing method. The outward swing is delayed slightly in order to strike the ball just as the ball bearings reach the target end of the tube.

The student, having experienced the two swing methods in their abbreviated form (putting strokes), can then advantageously use this experience to hit fuller shots at a driving range while using both swing methods.

DESCRIPTION OF THE INVENTION

Figure 1:
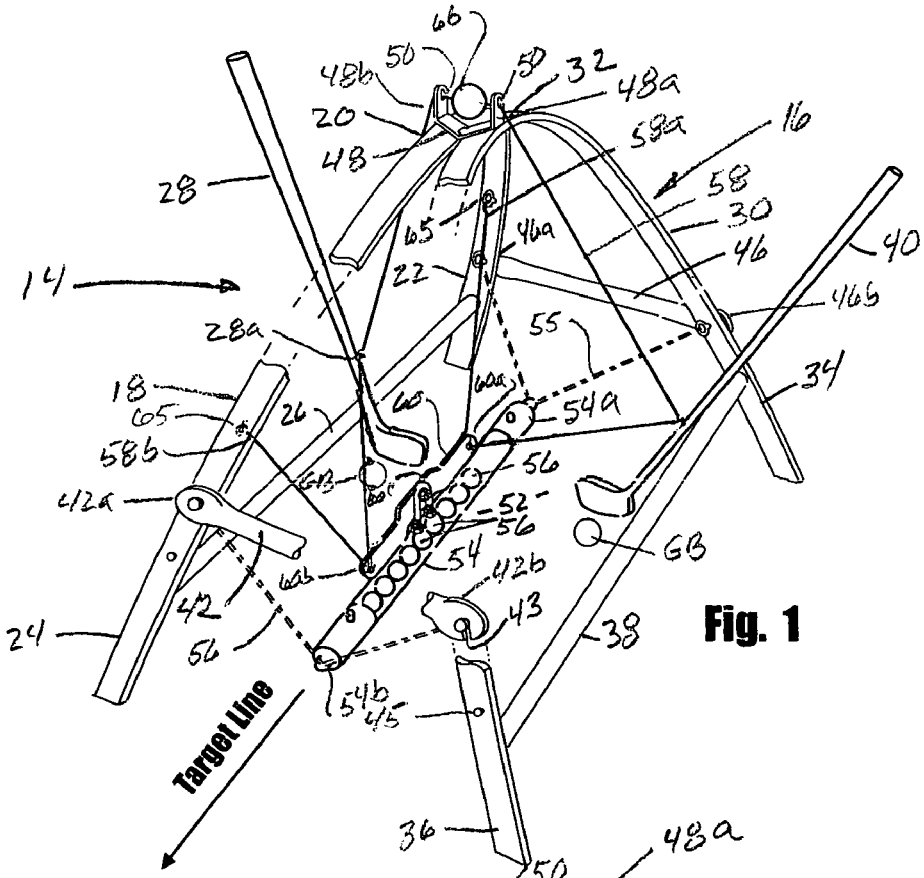
FIG. 1 is a generally perspective view of one form of the golf training machine of the invention.
Figure 2:
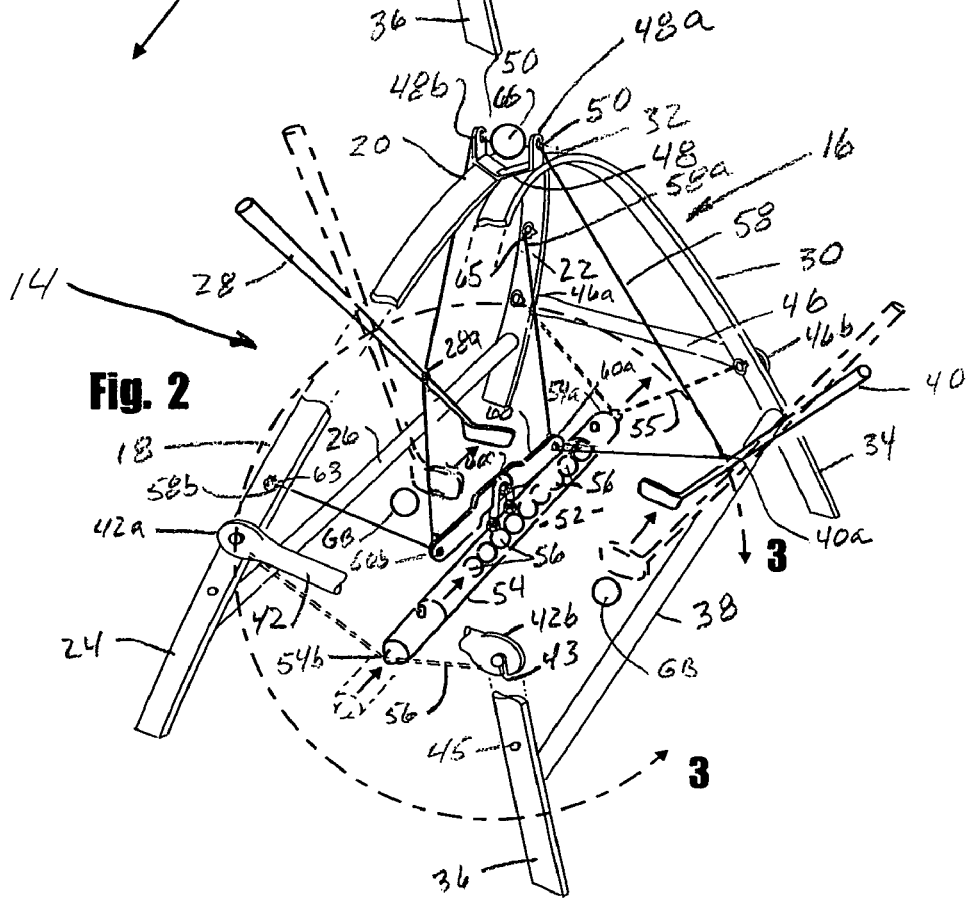
FIG. 2 is a generally perspective view, similar to FIG. 1, but showing the golf clubs moved into a backstroke position.

Referring to the drawings and particularly to FIGS. 1 and 2, one form of the golf training machine of the present invention is there illustrated and generally identified by the 14. Machine 14 here comprises a supporting frame 16 having a first generally U-shaped side member 18 having a bight portion 20 and first and second legs 22 and 24 respectively that are connected to bight portion 20. Connected to and extending between first and second legs 22 and 24 of the first generally U-shaped side member 18 is a first putter guide 26 for guiding movement of a first putter 28.

Also forming a part of the golf training machine 14 is a second generally U-shaped side member 30 having a bight portion 32 and first and second legs 34 and 36 respectively that are connected to bight portion 32. As indicated in FIG. 1 of the drawings, the U-shaped side members 18 and 30 are interconnected together at their respective bight portions. Connected to and extending between first and second legs 34 and 36 of the second generally U-shaped side member 30 is a second putter guide 38 for guiding movement of a second putter 40.

Interconnecting legs 24 and 36 of the supporting frame is a first brace 42 having a first end 42*a* that is pivotally connected to leg 24. The opposite end 42*b* of first brace 42 is provided with a slot 43 that is receivable over a locking pin 45 provided on leg 36. Interconnecting legs 22 and 34 of the supporting frame is a second brace 46 having a first end 46*a* that is pivotally connected to leg 22. The opposite end 46*b* of second brace 46 is provided with a slot (not shown) that is receivable over a locking pin provided on leg 34 (not shown). With the construction thus described, braces 42 and 46 can be pivoted from the locked position shown in FIG. 1 to an upward release position thereby permitting the first and second generally U-shaped side members 18 and 30 to be folded together for transport and storage of the machine.

Connected to the U-shaped side members 18 and 30 proximate their interconnection point is a generally U-shaped bracket 48 having spaced-apart first and second upstanding legs 48*a* and 48*b*, each having an aperture 50 therethrough.

Disposed within the interior space 52 defined by side members 18 and 30 of the supporting frame 16 is the highly novel impetus producing means of the invention. This important impetus producing means of the invention, which, in a manner presently to be described, is operably associated with the first and second putters 28 and 40, functions to produce impulses, or forces tending to return the first and second putters from their backstroke, or second positions shown in FIG. 2 of the drawings toward their first, or starting positions shown in FIG. 1 of the drawings.

In the present form of the invention, the impetus producing means comprises an elongated tubular member 54 that is connected to a supporting frame by a pair of supporting cords 55 and 56, which suspend the tubular member within the interior space 52 in the manner shown in FIG. 1 of the drawings. More particularly, supporting cord 55 is connected to the first end portion 54*a* of the tubular member, while supporting cord 56 is connected to the second end portion 54*b* of the tubular member.

In a manner presently to be described, tubular member 54 is movable between a first position shown in FIG. 1 of the drawings and a second, rearward position shown in FIG. 2. Contained within tubular member 54 for rolling movement therewithin between first and second positions is a plurality of weights, shown here as balls 56. More particularly, as the elongated tubular member is moved between the first and second positions, balls 56 will roll forwardly and rearwardly as depicted in FIGS. 1 and 2 of the drawings.

Figure 3:
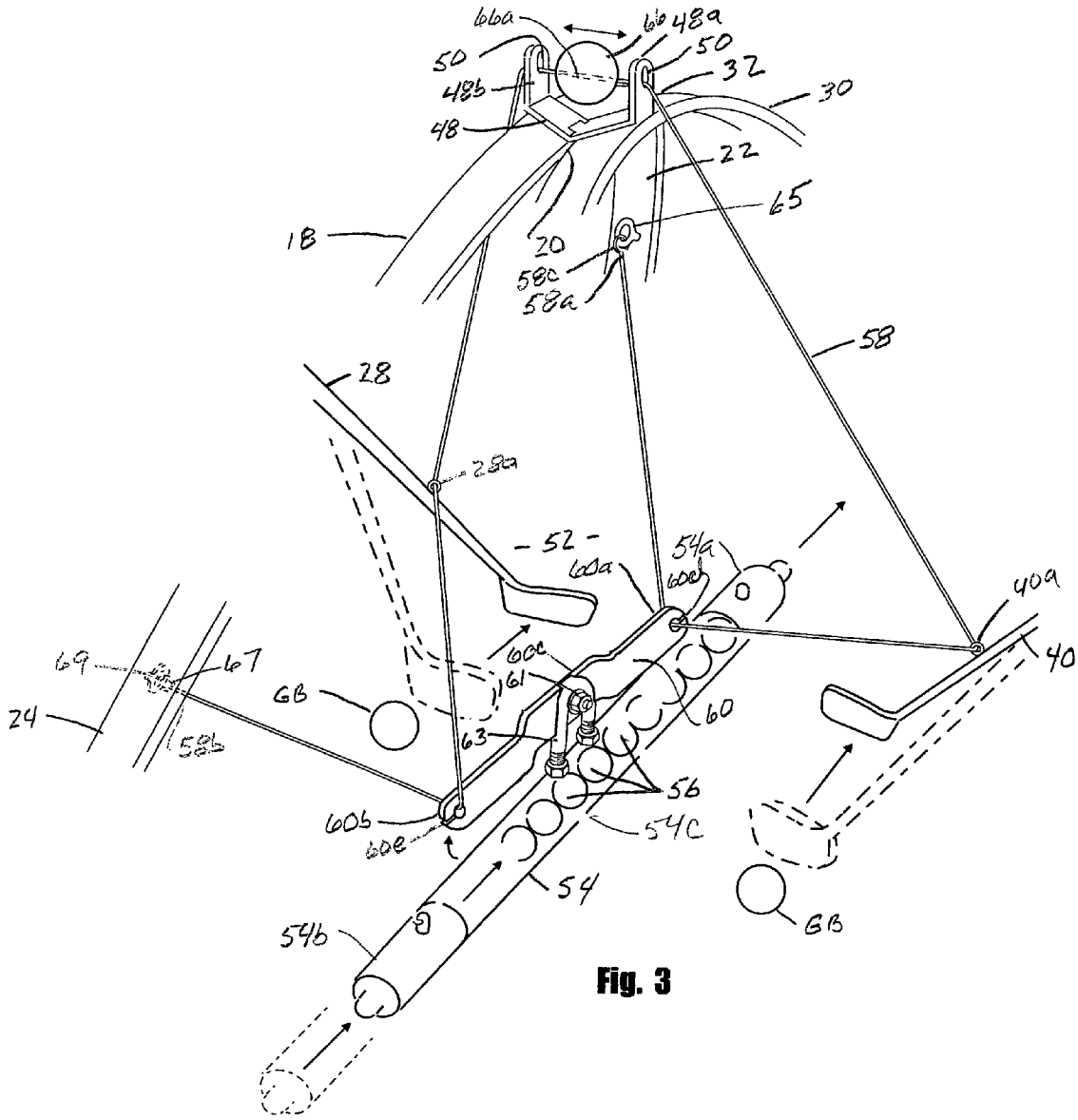
FIG. 3 is a greatly enlarged, generally perspective view of the portion of the golf training machine designated as 3-3 in FIG. 2.
Figure 4:
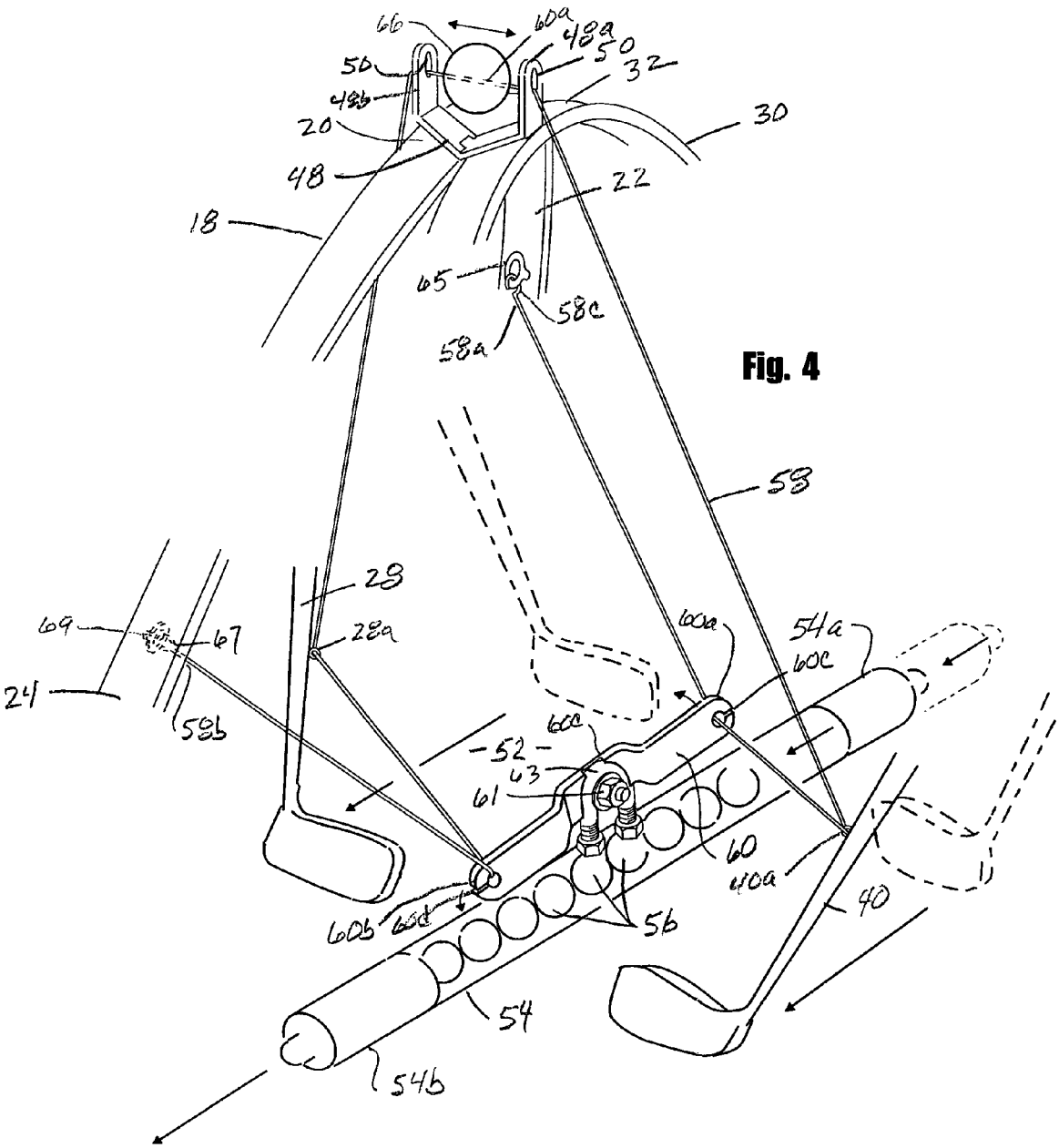
FIG. 4 is a greatly enlarged, generally perspective view, similar to FIG. 3, but showing the golf clubs moved into a forward ball striking position.

In the using the apparatus of the invention to convey to a trainee the differences between two putter swing methods, namely the "inward" swing method and the "outward" swing method, the instructor, along with first putter 28, is positioned on the first side of said supporting frame with the putter in sliding engagement with the first putter guide 26. Similarly, the trainee, along with the second putter 40, is positioned on the second side of the supporting frame with the second putter 40 in sliding engagement with the putter guide 38. As best seen in FIG. 3 of the drawings, a pivot plate 60 is pivotally connected to the central portion of elongated tubular member 54. Pivot plate 60, which forms an important aspect of the apparatus of the present invention, has an inboard end 60*a*, an outboard end 60*b* and a central portion 60*c*. Central portion 60*c* is pivotally connected by a bolt 61 to a generally "U"-shaped connector member 63 that is, in turn, interconnected with tubular member 54 proximate its central portion 54*c* (FIG. 3). As indicated by the arrows in FIGS. 3 and 4 of the drawings, pivot plate 60 is free to pivot about bolt 61 in an upward and downward direction.

As best seen by referring to FIGS. 1 and 2 of the drawings, the first and second putters 28 and 40 are operably interconnected with the pivot plate 60 by means of an elongated connector cord 58 having first and second ends 58*a* and 58*b*. More particularly, first end 58*a* of the connector cord is provided with a hook 58*c* (FIGS. 3 and 4) that enables the first end of the connector cord to be interconnected with a first cord connector member 65 that is connected to and extends outwardly from leg 22 of the first generally U-shaped side member 18. From the connector cord member 65, the connector cord extends downwardly to a point where it is releasably received within a slot 60*d* provided in inboard end 60*a* of the pivot plate 60. From the inboard end of the pivot plate, the connector cord extends upwardly to a point where it is slidably interconnected with an eyelet 40*a* provided on putter 40. From eyelet 40*a* the connector cord extends upwardly to a point where it passes through the aperture 50 formed in the first leg 48*a* of bracket 48. The connector cord is then entrained through a central bore 66*a* (FIGS. 3 and 4) formed in a cord guide member, shown here as a sphere 66 that is disposed between the first and second legs of bracket 48. Next, the connector cord extends through the aperture 50 formed in the second leg 48*b* of bracket 48 and then extends downwardly through an eyelet 28*a* provided on putter 28. From eyelet 28*a* the connector cord extends downwardly and passes through end 60*b* of pivot plate 60, which is provided with a slot 60*e*. From the outboard end of pivot plate 60, the connector cord, which is provided at its second end 58*b* with a second hook 67, extends upwardly for interconnection with a second cord connector member 69 (FIGS. 3 and 4) that is connected to and extends outwardly from leg 24 of the first generally U-shaped side member 18.

With the construction described in the preceding paragraph, during the training session, the instructor and the trainee simultaneously move their putter's rearwardly in the manner shown in FIG. 2 of the drawings. As the putters are moved rearwardly, the inboard end 60*a* of the pivot plate 60 will pivot downwardly relative to tubular member 54 causing the tubular member to swing rearwardly. As the tubular member swings rearwardly the balls 56 that are contained therewithin will roll toward end 54*a* of the tubular member in the manner shown in FIGS. 2 and 3 of the drawings.

After a slight time delay, the instructor and the trainee move their respective putters forwardly into impact with the golf balls "GB" and then forwardly of the interior space 52 to complete the follow-through. During the follow-through, end 60*a* of the pivot plate 60 will pivot upwardly relative to tubular member 54 causing the tubular member to swing forwardly in the manner illustrated in FIG. 4. As the tubular member swings forwardly, the balls 56 that are contained therewithin will roll toward the outboard end 54*b* of the tubular member.

Because of the manner in which the two putters are now interconnected with the tubular member 54 via the pivot plate 60, that is, with putter 28 interconnected with the forward portion 60*b* of the pivot plate and with putter 40 interconnected with the rearward portion 60*a* of the pivot plate, as the putters move forwardly, the instructor, as well as the trainee will experience the feeling of an inward swing.

Figure 5:
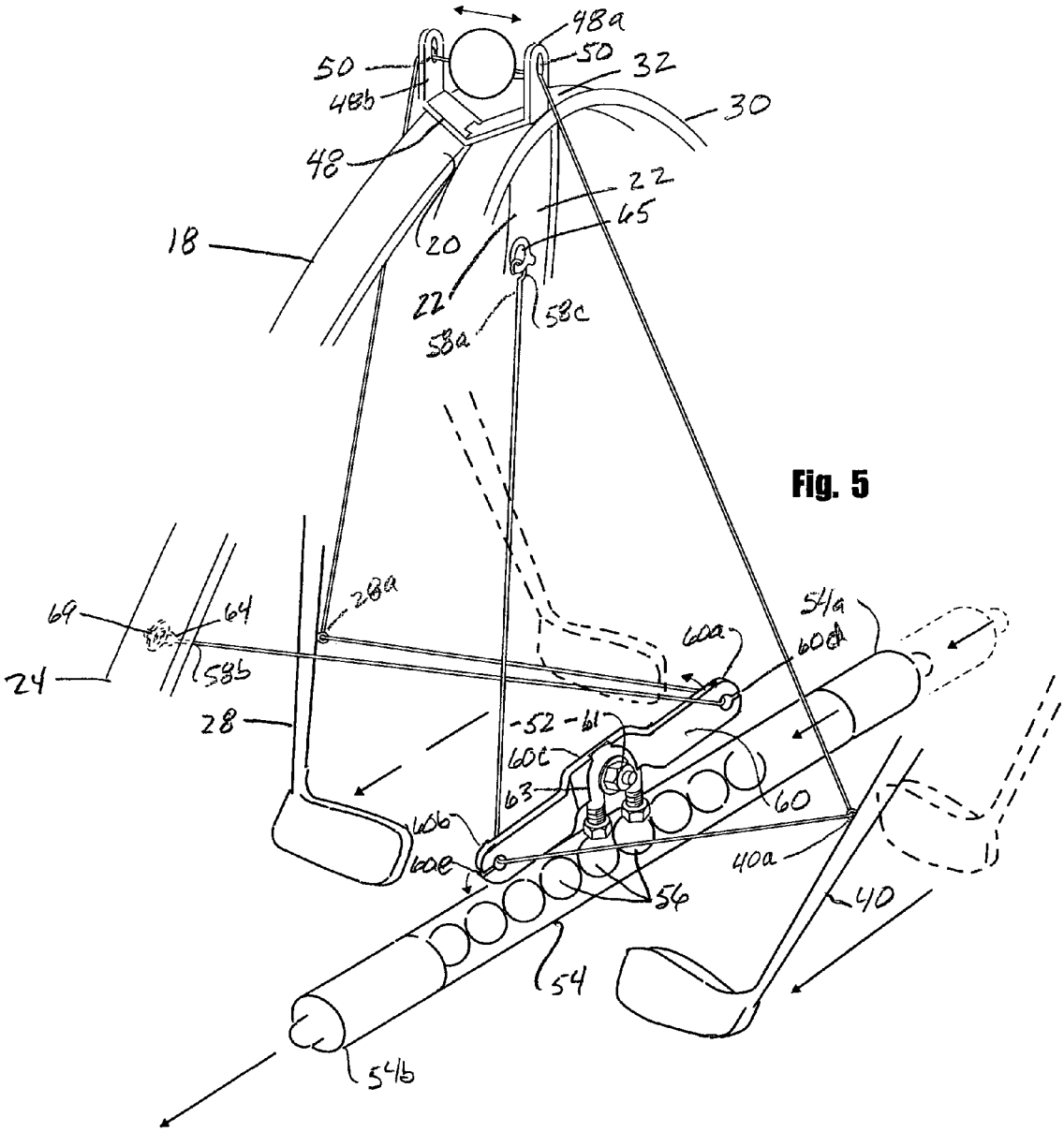
FIG. 5 is a generally perspective view of an alternate form of the golf training machine of the invention.

In order for the instructor and the trainee to experience the feeling of the outward swing, the connector cord 58 must be re-positioned relative to the pivot plate 60 in the manner illustrated in FIG. 5 of the drawings. More particularly, the connector cord is disconnected from the pivot plate by sliding the connector cord outwardly through the slots 60*d* and 60*e* provided in either end of the pivot plate (see FIG. 5). This done the section of the cord extending downwardly from the eyelet 40*a* of putter 40 will be inserted into the slot 60*d* formed in the outboard end of the pivot plate and the section of the cord extending downwardly from the eyelet 28*a* of putter 28 will be inserted into the slot 60*c* formed in the inboard end of the pivot plate. With this construction, the putter 28 is operably interconnected with the inboard end 60*a* of the pivot plate, while the putter 40 is operably interconnected with the outboard end 60*b* Of the pivot plate 60.

With the construction described in the preceding paragraph, during the training session, the instructor and the trainee simultaneously move their putter's rearwardly. As the putters are moved rearwardly, the inboard end 60*a* of the pivot plate 60 will pivot downwardly relative to tubular member 54 causing the tubular member to swing rearwardly. As the tubular member swings rearwardly the balls 56 that are contained therewithin will roll toward end 54*a* of the tubular member.

After a slight time delay, the instructor and the trainee move their respective putters forwardly into impact with the golf balls "GB" and then forwardly of the interior space 52 to complete the follow-through. During the follow-through, end 60*a* of the pivot plate 60 will pivot upwardly relative to tubular member 54 causing the tubular member to swing forwardly in the manner illustrated in FIG. 4. As the tubular member swings forwardly, the balls 56 that are contained therewithin will roll toward the outboard end 54*b* of the tubular member.

Because of the manner in which the two putters are interconnected with the tubular member 54 via the pivot plate 60, that is, with putter 28 now interconnected with the rearward portion 60*a* of the pivot plate and with putter 40 interconnected with the forward portion 60*b* of the pivot plate, as the putters move forwardly, the instructor, as well as the trainee will experience the feeling of an outward swing.

The student, having thusly experienced the two swing methods in their abbreviated form (putting strokes), can then advantageously use this experience to hit fuller shots at a driving range while using both swing methods.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A golf training machine comprising:

(a) a supporting frame having first and second sides defining an interior space;

(b) a first putter disposed proximate said first side of said supporting frame, said first putter being movable between first backstroke position and second forward positions;

(c) a second putter disposed proximate said second side of said supporting, said second putter being movable between first and second positions; and (d) impetus producing means disposed within said interior space of said supporting frame and connected to said first and second putters for producing impulses tending to move said first and second putters toward said second forward positions.

2. The golf training machine as defined in claim 1 in which said impetus producing means comprises:

(a) an elongated tubular member connected to said supporting frame and disposed within said the interior space, said tubular member having first and second end portions and being movable between first and second positions; and (b) a plurality of weights contained within said tube for movement therewithin between first and second positions as said elongated tubular member is moved between said first and second positions.

3. The golf training machine as defined in claim 2 further including a pivot plate pivotally connected to said elongated tubular member and operably associated with said first and second putters, said a pivot plate having first and second ends and being pivotally movable relative to said elongated tubular member by said first and second putters between first and second positions.

4. The golf training machine as defined in claim 2 further including:

(a) a first connector cord having a first end connected to said first putter and a second end connected to said first end of said pivot plate; and (b) a second connector cord having a first end connected to said second putter and a second end connected to said second end of said pivot plate.

5. The golf training machine as defined in claim 4 further including first and second spaced-apart putter guides connected to and extending between said first and second braces for guiding travel of said first and second putters.

6. The golf training machine as defined in claim 2 in which said weights comprise a plurality of spheres.

7. The golf training machine as defined in claim 2 further including:

(a) a first brace interconnecting said first and second sides of said supporting frame; and (b) a second brace interconnecting said first and second sides of said supporting frame.

8. A golf training machine comprising:

(a) a supporting frame having first and second sides and defining an interior space;

(b) an elongated tubular member connected to said supporting frame and disposed within said the interior space, said tube member having first and second end portions and being movable between first and second positions;

(c) a plurality of spheres contained within said tube for rolling movement therewithin between first and second positions as said elongated tubular member is moved between said first and second positions;

(d) a pivot plate pivotally connected to said elongated tubular member, said a pivot plate having first and second ends and being pivotally movable between first and second positions;

(e) a first putter disposed on said first side of said supporting frame and connected to said first end of said pivot plate, said first putter being movable between first and second positions to cause pivotal movement of said pivot plate and longitudinal movement of elongated tubular member between said first and second positions; and (f) a second putter disposed on said second side of said supporting frame and connected to said second end of said pivot plate, said second putter being movable between first and second positions to cause pivotal movement of said pivot plate and longitudinal movement of said elongated tubular member between said first and second positions.

9. The golf training machine as defined in claim 8 in which said supporting frame comprises:

(a) a first generally U-shaped side member having a bight portion and first and second legs connected to said bight portion; and (b) a second generally U-shaped side member connected to said first generally U-shaped member, said second generally U-shaped side member having a bight portion and first and second legs connected to said bight portion.

10. The golf training machine as defined in claim 9 in which said supporting frame comprises:

(a) a first putter guide connected to and extending between said first and second legs of said first generally U-shaped side member for guiding movement of said first putter between said first and second positions; and (b) a second putter guide connected to an extending between said first and second legs of said second generally U-shaped side member for guiding movement of said second putter between said first and second positions.

11. The golf training machine as defined in claim 9 in which said supporting frame further comprises:

(a) a first brace interconnecting said first and second legs of said first side member; and (b) a second brace interconnecting said first and second legs of said second side member.

12. The golf training machine as defined in claim 9 in which said supporting frame further comprises:

(a) a bracket connected to said byte portions of said first and second generally U-shaped side members, said bracket having spaced-apart legs, each leg having an aperture therethrough;

(b) a first cord connector member connected to said first leg of said first generally U-shaped side member and extending outwardly therefrom; and (c) a second cord connector member connected to said second leg of said first generally U-shaped side member and extending outwardly therefrom.

13. The golf training machine as defined in claim 12 further including an elongated connector cord having first and second ends, said first end being connected to said first cord connector member, said connector cord being interconnected with said first end of said pivot plate, being interconnected with said first putter, extending through said apertures formed in said legs of said bracket, being interconnected with said second putter, being interconnected with said second end of said pivot plate and having said second end connected to said second cord connector member.

14. The golf training machine as defined in claim 12 in which said elongated tube is suspended between said first and second sides of said supporting frame by first and second elongated support chords interconnected with said first and second sides of said supporting frame.

15. A golf training machine comprising:

(a) a supporting frame having first and second sides and comprising:

(i) a first generally U-shaped side member having a bight portion and first and second legs connected to said bight portion;

(ii) a first putter guide connected to and extending between said first and second legs of said first generally U-shaped side member;

(iii) a second generally U-shaped side member having a bight portion and first and second legs connected to said bight portion;

(iv) a second putter guide connected to and extending between said first and second legs of said second generally U-shaped side member;

(v) a first brace interconnecting said first and second side members;

(vi) a second brace interconnecting said first and second side members;

(vii) a first guide shaft connected to and extending between said first and second braces;

(viii) a second guide shaft connected to and extending between said first and second braces;

(ix) a bracket connected to said byte portions of said first and second generally U-shaped side members, said bracket having spaced-apart legs, each leg having an aperture therethrough;

(x) a first cord connector member connected to said first leg of said first generally U-shaped side member and extending outwardly therefrom; and (xi) a second cord connector member connected to said second leg of said first generally U-shaped side member and extending outwardly therefrom;

(b) an elongated tubular member connected to and disposed between said first and second generally U-shaped side members;

(c) a plurality of balls contained within said tube for rolling movement within said tube between first and second positions;

(d) a pivot plate pivotally connected to said elongated tubular member, said pivot plate having first and second ends and being pivotally movable between first and second positions;

(e) a first putter disposed on said first side of said supporting frame in sliding engagement with said first putter guide;

(f) a second putter disposed on said second side of said supporting frame in sliding engagement with said second putter guide; and (g) an elongated connector cord having first and second ends, said first end being connected to said first cord connector member, said connector cord being interconnected with said first end of said pivot plate, being interconnected with said first putter, extending through said apertures formed in said legs of said bracket, being interconnected with said second putter, being interconnected with said second end of said pivot plate and having said second end connected to said second cord connector member.

16. The machine is defined in claim 15 in which said elongated tube is suspended between said first and second sides of said supporting frame by first and second elongated support chords interconnected with said first and second sides of said supporting frame.

17. The machine is defined in claim 16 further including a generally "U"-shaped connector connected to said elongated tube, said pivot plate being pivotally connected to said generally "U"-shaped connector.

* * * * *